US007027025B2

(12) United States Patent
Takeda

(10) Patent No.: US 7,027,025 B2
(45) Date of Patent: Apr. 11, 2006

(54) LIQUID CRYSTAL DISPLAY DEVICE

(75) Inventor: Nobuhiro Takeda, Mobara (JP)

(73) Assignee: Hitachi, Ltd., Tokyo (JP)

( * ) Notice: Subject to any disclaimer, the term of this patent is extended or adjusted under 35 U.S.C. 154(b) by 372 days.

(21) Appl. No.: 10/212,208

(22) Filed: Aug. 6, 2002

(65) Prior Publication Data

US 2003/0034943 A1 Feb. 20, 2003

(30) Foreign Application Priority Data

Aug. 14, 2001 (JP) ..... 2001-246050

(51) Int. Cl.
*G09G 3/36* (2006.01)

(52) U.S. Cl. ..... 345/96; 345/95

(58) Field of Classification Search ..... 345/96, 345/95

See application file for complete search history.

(56) References Cited

U.S. PATENT DOCUMENTS 6,734,840 B1 * 5/2004 Fukutoku et al. ..... 345/96

* cited by examiner

*Primary Examiner*—Kent Chang
(74) *Attorney, Agent, or Firm*—Antonelli, Terry, Stout and Kraus, LLP

(57) ABSTRACT

In a liquid crystal display device having a plurality of pixels arranged in the form of a matrix, with groups of the pixels being arranged in lines along respective gate signal lines, the present invention provides for accumulating both signal levels of pixel data for odd-numbered lines of the pixels and for even-numbered lines of the pixels separately in every frame period, obtaining a subtracted value obtained by subtracting one of the accumulated values of the signal levels from the other, and transmitting an alternation signal which changes the voltage polarity applied to a liquid crystal layer by modifying the phase thereof on the basis of the subtracted value, so that flicker appearing on a display screen is efficiently suppressed.

6 Claims, 7 Drawing Sheets

LIQUID CRYSTAL DISPLAY DEVICE

BACKGROUND OF THE INVENTION

The present invention relates to a liquid crystal display device, and, more particularly, to an improved active matrix type of liquid crystal display device in which flicker is eliminated and the power consumption is reduced.

In an active matrix type of liquid crystal display device, on a liquid-crystal side surface of one of a pair of substrates, which are arranged to face each other in an opposed manner, while sandwiching liquid crystal material therebetween, there are formed gate signal lines, which extend in the x direction and which are arranged in parallel in the y direction, and drain signal lines, which extend in the y direction and which are arranged in parallel in the x direction. Regions which are surrounded by these respective gate lines and drain lines constitute pixel regions.

Each pixel region includes a switching element which is operated in response to a scanning signal from a one-side gate signal line and a pixel electrode to which a video signal is supplied from a one-side drain signal line by way of the switching element. Between the pixel electrode and a counter electrode, which is formed on a liquid-crystal-side surface of either one of the pair of substrates, an electric field is generated, and the optical transmissivity of the liquid crystal material is controlled in response to the electric field.

Further, one of the gate signal lines is selected in response to a scanning signal supplied from a vertical scanning driving circuit, and a video signal is supplied to each drain signal line from a video signal driver circuit at the timing of selection of the gate signal line.

In a liquid crystal display device having such a constitution, a so-called dot inversion driving method has been employed, in which, to prevent the deterioration of the liquid crystal material caused by polarization derived from applying a voltage having a direct current component to the liquid crystal material for a long time, the polarity of the voltage applied to respective liquid crystals of neighboring pixel regions is inverted (alternated), so that the polarity of the voltage applied to each liquid crystal is inverted at every frame.

Further, as a display mode of the liquid crystal display device, a dot matrix display and a character display have been known, wherein data inputted to the above-mentioned video signal driver circuit is constituted of dot-matrix data.

Still further, in a so-called transmission type liquid crystal display device, which is provided with a backlight on a back surface of a liquid crystal display panel, image display is usually performed while setting the brightness of the backlight at a fixed value.

SUMMARY OF THE INVENTION

However, in such a liquid crystal display device, which adopts the above-mentioned dot inversion driving method, a display pattern inevitably exists which offsets the alternation of liquid crystal driving, and it has been pointed out that flicker occurs in such a case.

Further, it also has been pointed out that the dot-matrix data inputted to the above-mentioned video signal driver circuit increases the power consumption required for transferring such data.

Still further, recently, it has been pointed out that not only still images, but also moving images, are being visualized in large quantity as display images, and the brightness of these images is slightly reduced when the moving images are visualized; and, hence, the moving images cannot be clearly recognized.

The present invention has been made in view of the above-mentioned circumstances, and it is an object of the present invention to provide a liquid crystal display device which can suppress the generation of flicker.

It is another object of the present invention to provide a liquid crystal display device in which the power consumption thereof can be reduced.

It is still another object of the present invention to provide a liquid crystal display device which can clearly display moving images.

Typical aspects and features of the present inventions, as disclosed in the present application, will be summarized as follows.

[Structural Feature 1 According to the Present Invention]

In a liquid crystal display device which has a plurality of pixels arranged in the form of a matrix, with each group of pixels being formed in respective lines along gate signal lines, and in which there is means for alternating the polarities of voltages applied to the liquid crystal material during a frame period with respect to an alternation signal, the present invention provides: means for accumulating signal levels of pixel data for odd-numbered lines of the pixels during every frame period (accumulator A); means for accumulating signal levels of pixel data for even-numbered lines of the pixels during every frame period (accumulator B); subtracting means for obtaining a subtracted value by subtracting one of the accumulated values of the signal levels for the odd-numbered lines and for the even-numbered lines from one another (subtractor), and alternation signal transmitter means for transmitting another alternation signal, that is different from (e.g. out of phase with) the current alternation signal, when the subtracted value obtained by the subtracting means is not less than a reference value (e.g. selector).

In a liquid crystal display device having such a constitution, there is no possibility that the voltage applying polarity and the display data are biased; and, hence, the liquid crystal applying voltage is made uniform with respect to the common voltage. Accordingly, it is unnecessary to increase the quantity of current supplied to the common electrode, so that the power consumption can be suppressed.

[Structural Feature 2 According to the Present Invention]

The structural feature 2 of the liquid crystal display device according to the present invention is defined, for example, by (a) means for receiving input data, including a character display and dot matrix data, and for producing the dot matrix data from the input data when a display enable signal is in a High-state (e.g. a logic element receiving the input data and the display enable signal); (b) means for generating character data from the input data when the display enable signal is in a Low-state (e.g. a color palette converting circuit, a character-generating circuit, or a character-address generating circuit, and a logic element disposed prior thereto); and (c) means for outputting display data by synthesizing the character data with the dot matrix data (e.g. an image synthesizing circuit), each provided for the liquid crystal display device.

In the liquid crystal display device having such a constitution, when the character display is performed along with a dot matrix display, input data for the character display is fetched as character data and is synthesized with the dot-matrix data. Due to such a constitution, the power consumption necessary for data transfer can be reduced.

[Structural Feature 3 According to the Present Invention]

In a liquid crystal display device having a liquid crystal display panel to which display data is inputted and a backlight arranged at a back surface of the liquid crystal display panel, the present invention provides: a first means for identifying gray scales in respective pixel data included in the display datum (e.g. a gray scale decoder); a second means for detecting the existence of predetermined gray scale levels in the gray scales identified by the first means (e.g. gray scale resistors provided for every predetermined gray scale level); a third means for totaling up the number of the gray scale levels detected by the second means (e.g. an adder); and a fourth means for outputting a control signal to the backlight, which falls into one of a plurality of brightness control ranges of the backlight, with respect to the number of the gray scale levels totaled up by the third means, wherein the fourth means divides the brightness range of the backlight to be regulated thereby into a plurality of brightness control ranges (e.g. a resistor).

In the liquid crystal display device having such a constitution, moving images displayed on the liquid crystal display panel are displayed with a brightness which is greater than the brightness which is obtained when still images are displayed. Due to such a constitution, the motion of the moving images can be clearly displayed. On the other hand, it also has been confirmed that, when the display images are still images, the still images can be clearly displayed even when the brightness thereof is not so large.

Further, the distinction between the moving images and the still images is detected, and an optimum brightness display is produced in response to the result of detection; and, hence, it is possible to obtain an advantageous effect in that the power consumption can be reduced.

DETAILED DESCRIPTION

Preferred embodiments of a liquid crystal display device according to the present invention will be described hereinafter in conjunction with the drawings.

EMBODIMENT 1

<<Circuit Diagram of Liquid Crystal Display Panel PNL>>

Figure 2:
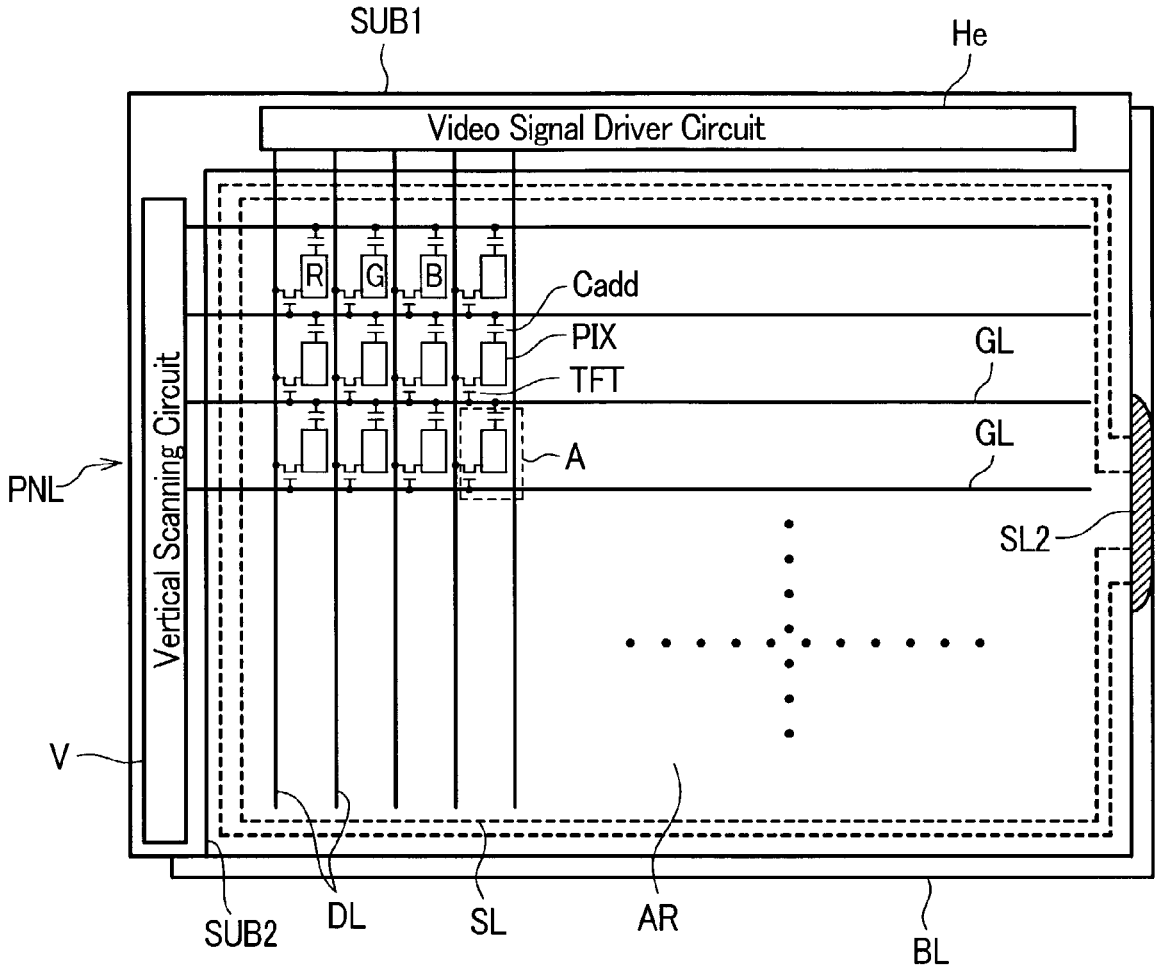
FIG. 2 is an equivalent circuit diagram showing one embodiment of a liquid crystal display panel of the liquid crystal display device according to the present invention.

FIG. 2 is a view showing a circuit of a liquid crystal display panel PNL. Although the drawing shows a circuit diagram of the display panel, it is depicted so as to correspond to an actual geometric arrangement of the elements.

First of all, there is provided a transparent substrate SUB 1. On a surface (the surface which faces a transparent substrate SUB2 in an opposed manner), gate signal lines GL, which extend in the x direction and are arranged in parallel in the y direction, and drain signal lines DL, which extend in the y direction and are arranged in parallel in the x direction, are formed. Regions surrounded by the gate signal lines GL and the drain signal lines DL constitute pixel regions (pixels), and these respective pixels, which constitute a liquid crystal display portion AR, are arranged in a matrix array.

Within each pixel region, there is a switching element (thin film transistor) TFT, which is operated in response to a scanning signal supplied from a one-side gate signal line GL, and a pixel electrode PIX, to which a video signal from a one-side drain signal line DL is supplied through the switching element TFT. An electric field is generated between the pixel electrode PIX and a counter electrode CT (not shown in the drawing), which is provided on either one of the respective transparent substrates, in each pixel, and the optical transmissivity of the liquid crystal for the selected pixel is controlled by the electric field.

Each gate signal line GL has one end thereof connected to a vertical scanning driving circuit V, and a scanning signal is supplied to each gate signal line GL from the vertical scanning driving circuit V. Further, each drain signal line DL has one end thereof connected to a video signal driver circuit He, and a video signal is supplied to each drain signal line DL from the video signal driver circuit He. Here, respective drain signal lines DL are constituted of signal lines which sequentially repeat a color display of R, G, B from the left toward the right in the figure, for example. Accordingly, three pixels, which are arranged adjacent to each other and are connected to the same gate signal line GL, constitute one pixel in a color display.

The above-mentioned transparent substrate SUB1 is arranged to face the other transparent substrate SUB2 with a liquid crystal material being disposed therebetween, and a sealing material SL, which surrounds the above-mentioned liquid crystal display portion AR so as to seal the liquid crystal, is used for fixing the above-mentioned transparent substrates SUB1, SUB2 to one another.

Further, the liquid crystal display panel PNL having such a constitution is of a so-called transmission type, and so a backlight BL is arranged on a back surface of the panel PNL.

<<Circuit of Liquid Crystal Display Panel PNL and Periphery Thereof>>

Figure 3:
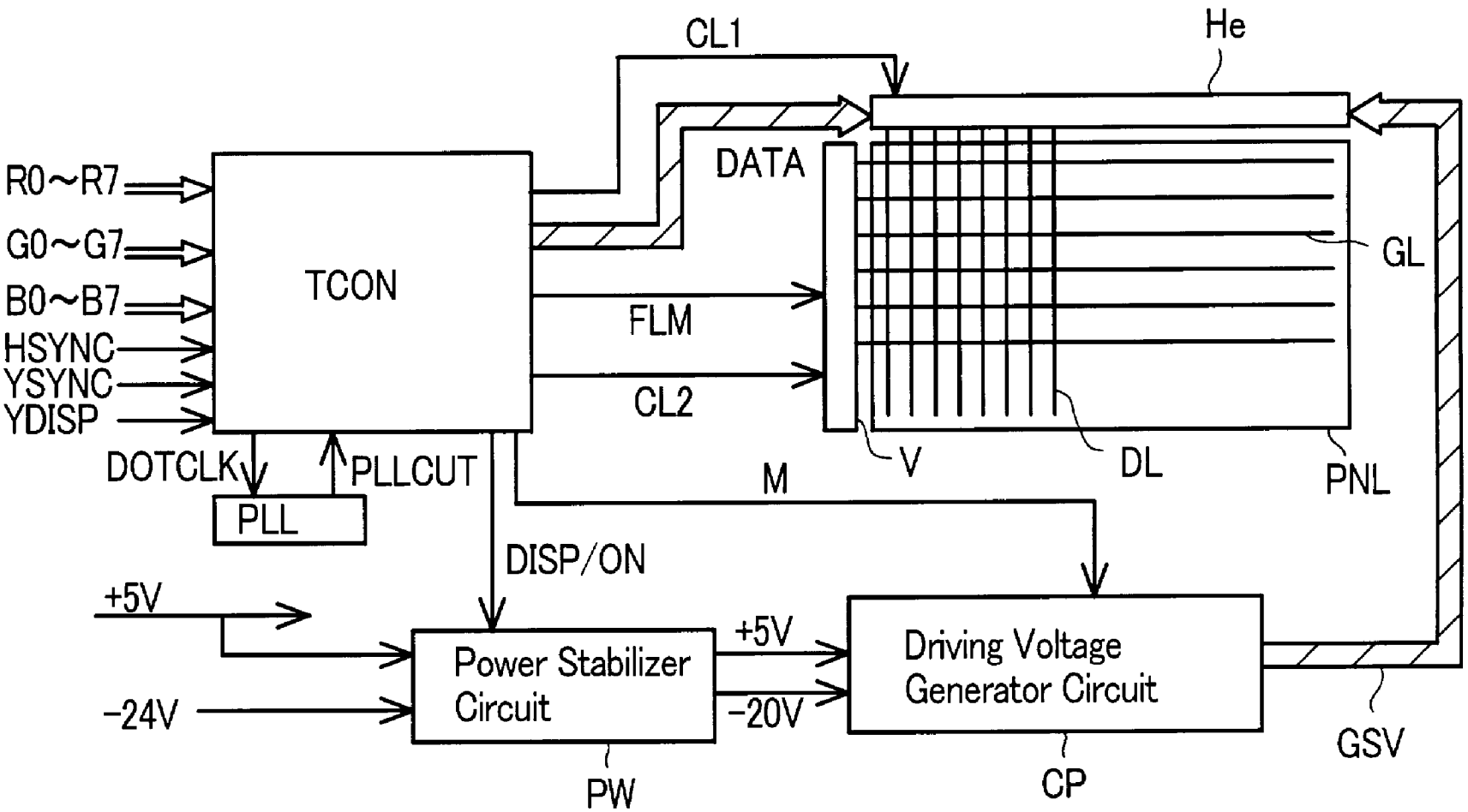
FIG. 3 is a schematic diagram showing the liquid crystal display panel and a periphery thereof of the liquid crystal display device according to the present invention.

FIG. 3 is a schematic diagram of the above-mentioned liquid crystal display panel PNL and the periphery thereof. For the sake of brevity, a case in which the liquid crystal display device is configured for the display of 256 colors, for example, is shown in FIG. 3.

First of all, an interface part, which corresponds to a microcomputer system or the like, is constituted of a timing converter TCON. To an input terminal of this timing converter TCON, color data $R_0$–$R_7$, $G_0$–$G_7$, $B_0$–$B_7$, which correspond to inputs of R, G, B of a standard color CRT (cathode ray tube), a horizontal synchronizing signal HSYNC, a vertical synchronizing signal VSYNC, a display timing signal YDISP and the like are inputted. Further, signals, which are obtained by converting respective data from the above-mentioned input terminal and which drive the liquid crystal display panel PNL, are outputted from an output terminal of the timing converter TCON.

A phase locked loop circuit PLL is connected to the timing converter TCON, and a 1 dot clock pulse DOTCLK is inputted to the phase locked loop circuit PLL and a clock pulse PLLOUT is supplied to the timing converter TCON by this phase locked loop circuit PLL.

The vertical scanning driving circuit V, which is mounted on the liquid crystal display panel PNL, is constituted of a dynamic-type shift resister and a driver, for example, wherein a frame signal (FLM signal) and a pulse CL2, which corresponds to the scanning timing, are inputted to the vertical scanning driving circuit V from the output terminal of the above-mentioned timing converter TCON. Due to such a constitution, a scanning signal is sequentially outputted to respective gate signal lines GL, which are respectively connected to output terminals of the vertical scanning driving circuit V.

Further, to the video signal driver circuit He that is mounted on the liquid crystal display panel PNL, a clock pulse CL1, which is outputted from the output terminal of the timing converter TCON, and data DATA of several bit units, which is transmitted in serial form through a signal bus, are inputted. The clock pulse CL1 is used for latching the above-mentioned data DATA at the video signal driver circuit He for one line transferred in serial order. That is, the clock pulse CL1 is generated when the transfer of data for one line is completed.

The transferred data is held and a driving voltage for one line is formed based on the data, and the data is written in parallel in the pixel for one line corresponding to the gate signal line GL selected by the above-mentioned vertical scanning driving circuit V. In this case, along with the above-mentioned writing into the pixel, the serial fetching of data corresponding to a next line is performed in response to the above-mentioned clock pulse CL1.

On the other hand, there is provided a power stabilizer circuit PW, which generates stabilized voltages, such as +5V and −20V, which are necessary for use as driving voltages, upon receiving two voltages, such as +5V and −24V, for example. The power stabilizer circuit PW is effectively operated upon receiving a display control signal DISP/ON from the above-mentioned timing converter TCON.

Further, the stabilized voltages from the power stabilizer circuit PW are supplied to a driving voltage generator circuit CP, and the driving voltage generator circuit CP generates respective driving voltages GSV that are allocated to respective gray scales. The respective driving voltages GSV are supplied to the video signal driver circuit He.

<<Driving Voltage Generator Circuit>>

Figure 4:
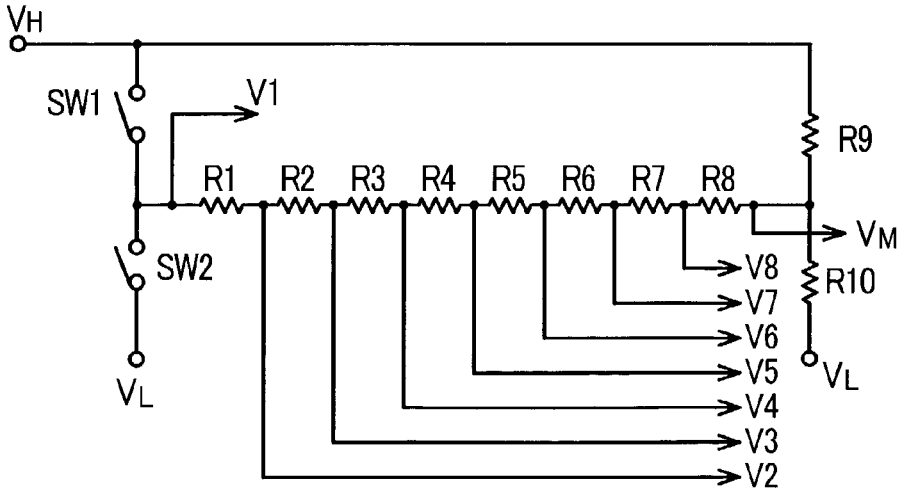
FIG. 4 is a schematic circuit diagram showing one embodiment of a driving voltage generator circuit of the liquid crystal display device according to the present invention.

FIG. 4 shows one example of the above-mentioned driving voltage generator circuit CP, in which the polarities of the driving voltages (also called "Gray Scale Voltage", GSV in FIG. 3), which are outputted in response to gray scales, are inverted between positive/negative polarity in every gate signal line GL and for every frame. Due to such a constitution, the liquid crystal is subjected to a so-called alternation driving (the counter electrode being fixed in this case); and, hence, there is no possibility that a direct current component will be applied to the liquid crystal. Thus, it is possible to obtain the advantageous effect that the lifetime of the liquid crystal is prolonged.

In the drawing, a series circuit, including a switch SW 1 and a switch SW2, is connected between a high-level voltage $V_H$ (+5V for the example of FIG. 3) and a low-level voltage $V_L$ (−20V for the example of FIG. 3), and a driving voltage $V_1$ is outputted from the connection point of the switches SW1 and SW2. Further, a series circuit, including a resister $R_9$ and a resister $R_{10}$, is connected between the high-level voltage $V_H$ and the low-level voltage $V_L$, and an intermediate voltage $V_M$ is generated at the connection point of the resisters $R_9$ and $R_{10}$.

With respect to the operation of the switches SW1 and SW2, when one of them assumes the ON state, the other assumes the OFF state. This changeover is performed in response to the changeover of the gate signal lines GL, for example. A series circuit consisting of resisters $R_1$ to $R_8$ is connected between a connection point of the resisters $R_9$ and $R_{10}$ and a connection point of the switches SW1 and SW2, wherein respective driving voltages $V_2$ to $V_8$ are outputted from lines connected between each of respective resisters $R_1$ to $R_8$. Respective driving voltages GSV, that are outputted from the driving voltage generator circuit CP, include voltages of eight stages and adopt the descending order of driving voltages $V_1$ to $V_8$.

Due to such a constitution, when the odd-numbered gate signal lines GL are selected, the switch SW1 is turned ON in response to the signal M received from the timing converter TCON, and driving voltages of positive polarity $+V_1$ to $+V_8$ are formed in response to the high-level voltage $V_H$ and the intermediate voltage $V_M$. Then, when the even-numbered gate signal lines GL are selected, the switch SW2 is turned ON in response to the signal M received from the timing converter TCON, and driving voltages of negative polarity $-V_1$ to $-V_8$ are formed in response to the low-level voltage $V_L$ and the intermediate voltage $V_M$. Such changeover of the switches SW1 and SW2 is performed at every changeover of a frame.

Here, in this embodiment, with respect to a pixel group driven by respective gate signal lines GL, the polarities of voltages applied to respective liquid crystals of the pixels which are arranged close to each other are also inverted. This inversion is performed inside of the above-mentioned video signal driver circuit He, for example.

<<Voltage Polarity Inversion Adjusting Circuit>>

Figure 1:
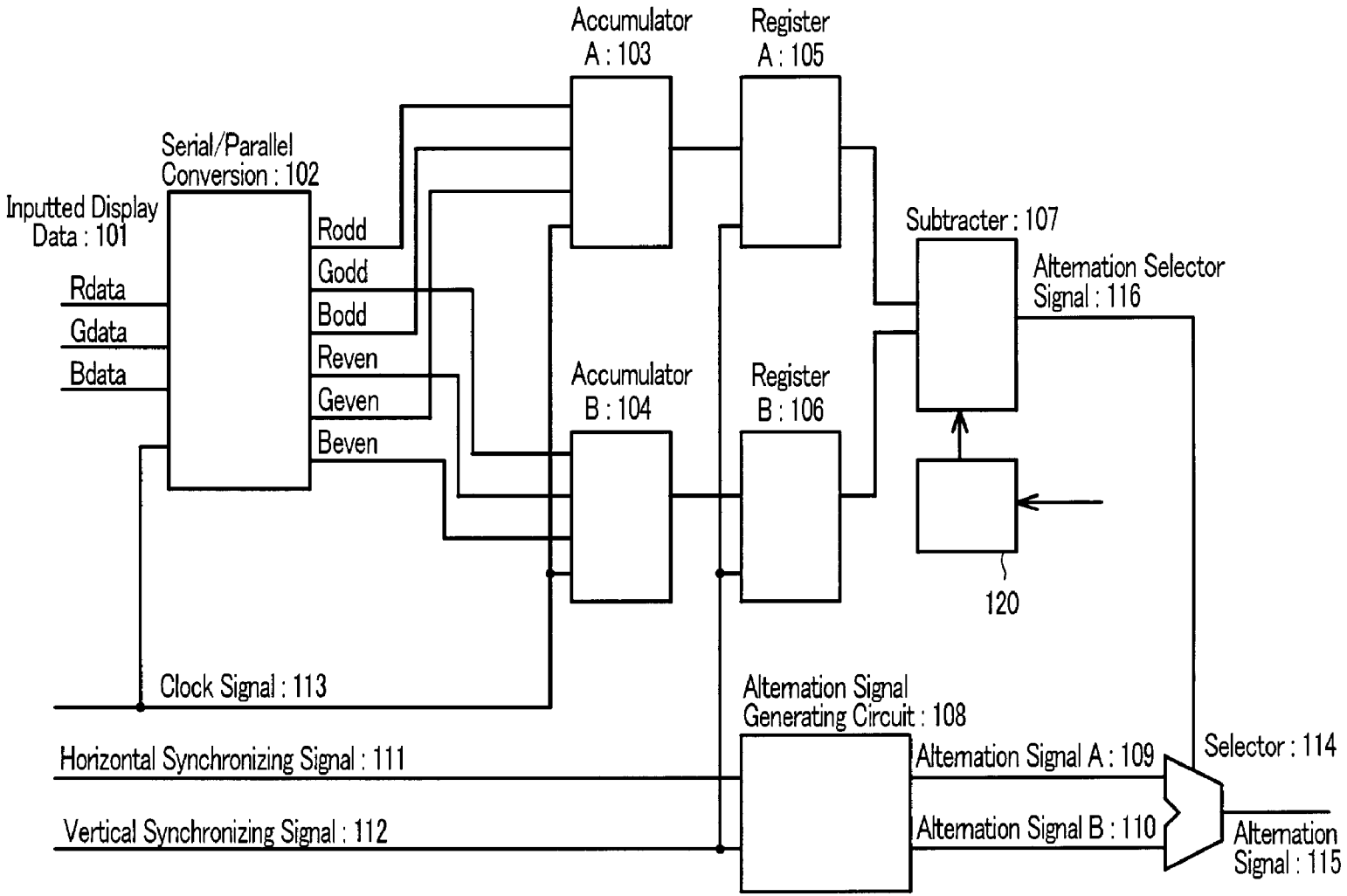
FIG. 1 is a block diagram showing one embodiment of a liquid crystal display device according to the present invention.

FIG. 1 shows a circuit for adjusting the above-mentioned inversion of the polarity of the voltage applied to the liquid crystal material in response to input data inputted to the timing controller TCON (hereinafter referred to as inputted display data), and this circuit is incorporated into the above-mentioned timing controller TCON, for example.

In the circuit of FIG. 1, first of all, there is provided a serial/parallel converter 102. Inputted display data 101 is configured to be inputted into this serial/parallel converter 102. The inputted display data 101 includes a large number of pixel data, and this pixel data is outputted from the serial/parallel converter 102, after being classified into pixel data of odd-numbered lines and pixel data of even-numbered lines in the vertical scanning of the liquid crystal display part.

Further, the respective pixel data of the inputted display data 101 respectively include information on red (R), green (G), blue (B) colors of the color display, and inputting of the inputted display data 101 to the serial/parallel converter 102 is performed through different input terminals Rdata, Gdata, Bdata, which correspond to respective information of red (R), green (G), blue (B) colors for every pixel data. The outputting of the inputted display data 101 from the serial/ parallel converter 102 is performed through different output terminals Rodd, Godd, Bodd, which correspond to respective information of red (R), green (G), blue (B) colors of respective pixel data of the odd-numbered lines and is performed through different output terminals Reven, Geven, Beven, which correspond to respective information of red (R), green (G), blue (B) colors of respective pixel data of the even-numbered lines. Such operations are performed with respect to respective pixels which differ in color information in response to the inputting of a clock signal 113 to the serial/parallel converter 102.

Then, outputs from the output terminals Rodd, Bodd, Geven of the serial/parallel converter 102 are inputted to an accumulator A103, while outputs from the output terminals Godd, Reven, Beven of the serial/parallel converter 102 are inputted to an accumulator B104.

In the accumulator A103, the signal levels (corresponding to brightness) of respective pixel data, which are inputted to the accumulator A103, are sequentially accumulated, and an accumulated value is temporarily stored in a register A105. Further, and simultaneously therewith, in the accumulator B104, the signal levels of respective pixel data, which are inputted to the accumulator B104, are sequentially accumulated, and an accumulated value is temporarily stored in a register B106.

Clock signals 113 are respectively inputted to the accumulators A103, B104, and accumulations of signal lines in the accumulators A103, B104 are performed for respective pixels which differ in color information. On the other hand, vertical synchronizing signals 112 are inputted to the registers A105, B106, respectively, and the accumulations of signal levels in the registers A105, B106 are performed for every frame of the liquid crystal display. That is, due to such a constitution, it is possible to obtain the accumulated value of signal levels of pixel data (R, G, B) of respective odd-numbered lines and the accumulated value of signal levels of pixel data (R, G, B) of respective even-numbered lines for every frame.

Then, signals which correspond to respective accumulated values are inputted to a subtracter 107. The result of subtraction between the accumulated value stored in the register A105 and the accumulated value stored in the register B106 is obtained by the subtracter 107. The subtracter 107 outputs an alternation selector signal 116, when a subtracted value calculated by the subtracter 107 becomes equal to or more than a reference value. Here, the above-mentioned subtracter 107 allows inputting of a signal from a reference value changing means 120, which changes the reference value so that the reference value can be arbitrarily set. In this regard, an operator can operate the reference value changing means 120 so as to change the reference value to a given value based on the observation of a display surface of the liquid crystal panel, for example.

On the other hand, an alternation signal generating circuit 108 is also provided. The alternation signal generating circuit 108 generates an alternation signal A109 and an alternation signal B110, whose phases are shifted by 180°, in response to a horizontal synchronizing signal 111 and a vertical synchronizing signal 112. These alternation signals A109, B110 are outputted to a selector 114, and the selector 114 changes over between the alternation signals A109, B110, based on the selection indicated by the alternation selector signal 116, and outputs an alternation signal 115. The alternation signal 115 is used as a signal for changing over switches SW1, SW2 of the driving voltage generator circuit CP, and it is used for the inversion of the polarities of the neighboring pixels in the pixel group in each line in the video signal driver circuit He.

The liquid crystal display device having such a constitution detects a case in which there exists a bias with respect to display data quantities of positive polarity and negative polarity in one frame and changes the alternation period of the liquid crystal, thus suppressing the generation of flicker and preventing an increase in the power consumption.

With respect to the generation of the alternation period of the liquid crystal in the conventional liquid crystal display device which is not constituted in such a manner, a display pattern which offsets the alternation exists, and, hence, flicker is generated. Further, there has been a drawback with such display devices in that, due to the bias of the display data at the positive polarity and the negative polarity with respect to the polarity of the voltage applied to the liquid crystal, the current to the common electrode is increased, whereby the power consumption is increased.

Figure 5:
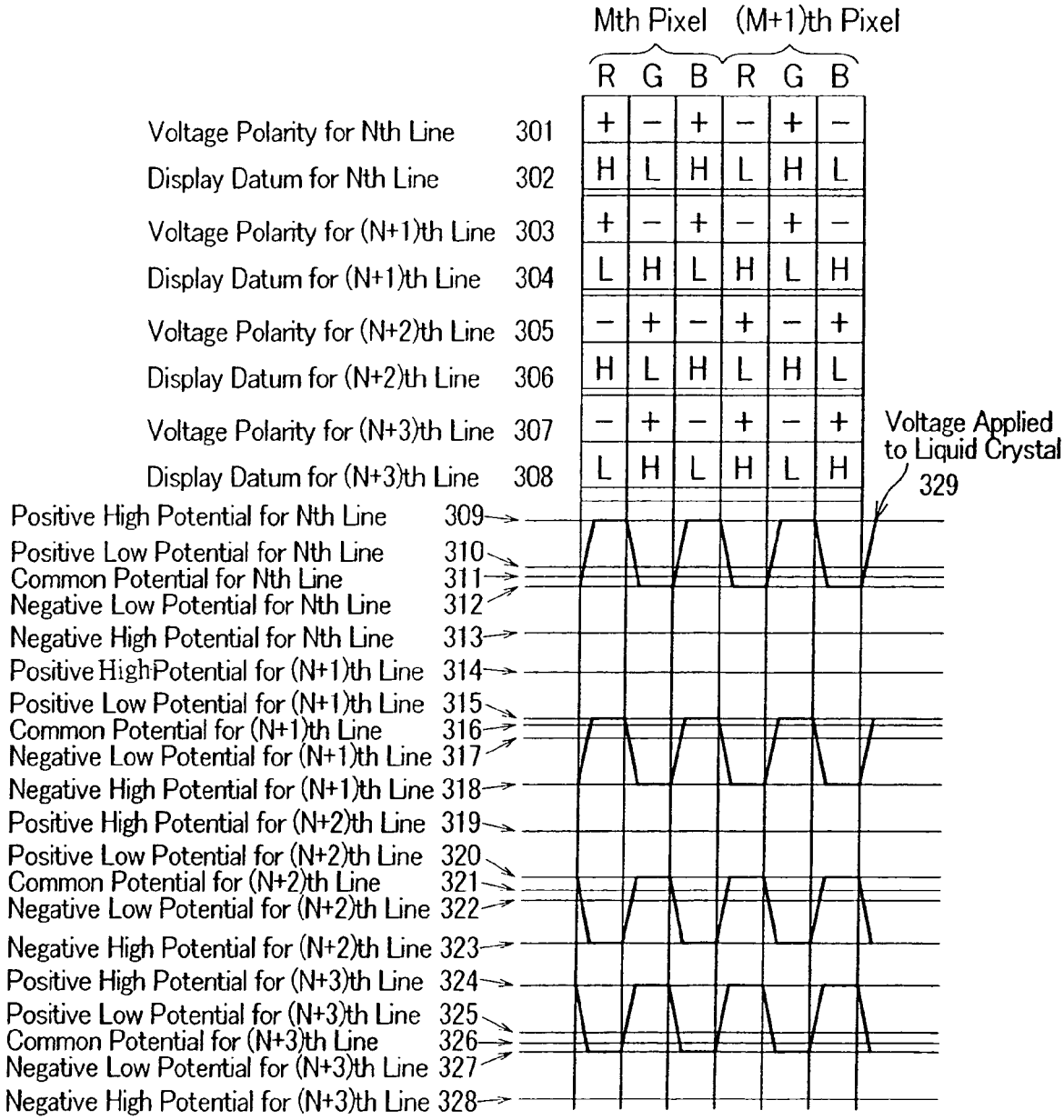
FIG. 5 is a diagram showing an advantageous effect obtained by the provision of the circuit shown in FIG. 1 of the liquid crystal display device according to the present invention.

FIG. 5 is a view showing one example of the relationship between the liquid crystal applying voltage and the alternation signal established by the above-mentioned constitution in accordance with the present invention.

As can be understood from FIG. 5, while a white and black inversion pattern is inputted for every dot and every line, the alternation signal is changed for every dot and every two lines. Accordingly, there is no possibility that the polarity of applied voltages 301, 303, 305, 307 and the display data 302, 304, 306, 308 are biased, and the liquid crystal applying voltage 329 is made uniform with respect to common voltages 311, 316, 321, 326. Accordingly, the quantity of current supplied to the common electrodes is not increased, and, hence, the power consumption can be suppressed.

Further, for similar reasons, it is possible to suppress the generation of flicker that is derived from the non-uniformity of common electrodes on the display screen of the liquid crystal display panel.

Figure 6:
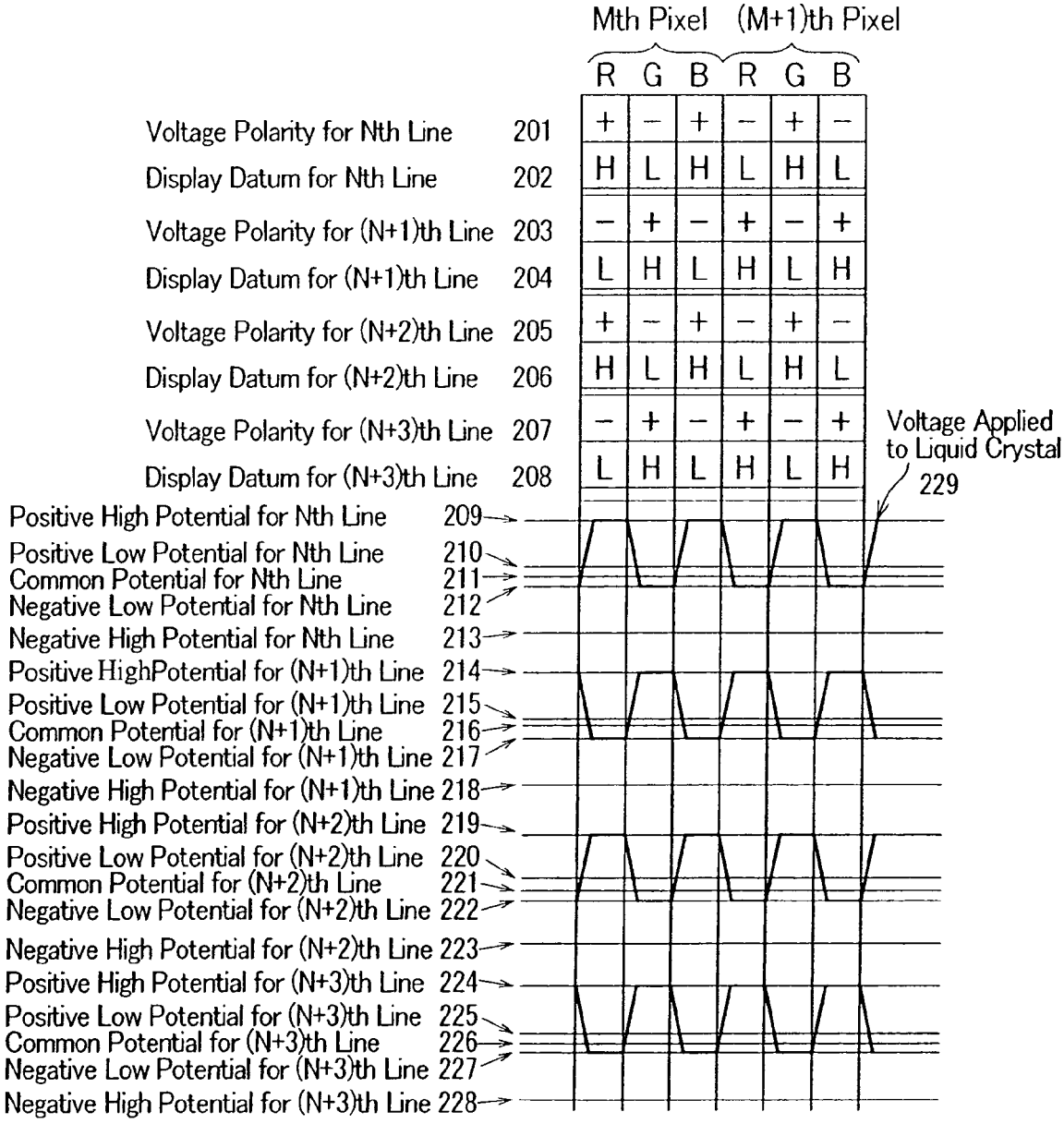
FIG. 6 is a diagram showing drawbacks of a conventional liquid crystal display device in comparison to FIG. 5.

FIG. 6 is a view showing one example of the relationship between the liquid crystal applying voltage and the alternation signal in the conventional liquid crystal display device, in comparison to FIG. 5. As can be seen from FIG. 6, the alternation signal is fixed; and, hence, when the display data is formed of a white and black inversion pattern for every dot and every line, the polarity of the applying voltages 201, 203, 205, 207 and the display data 201, 204, 206, 208 are biased, whereby the liquid crystal applying voltage 229 is biased with respect to the common electrodes.

EMBODIMENT 2

Figure 7:
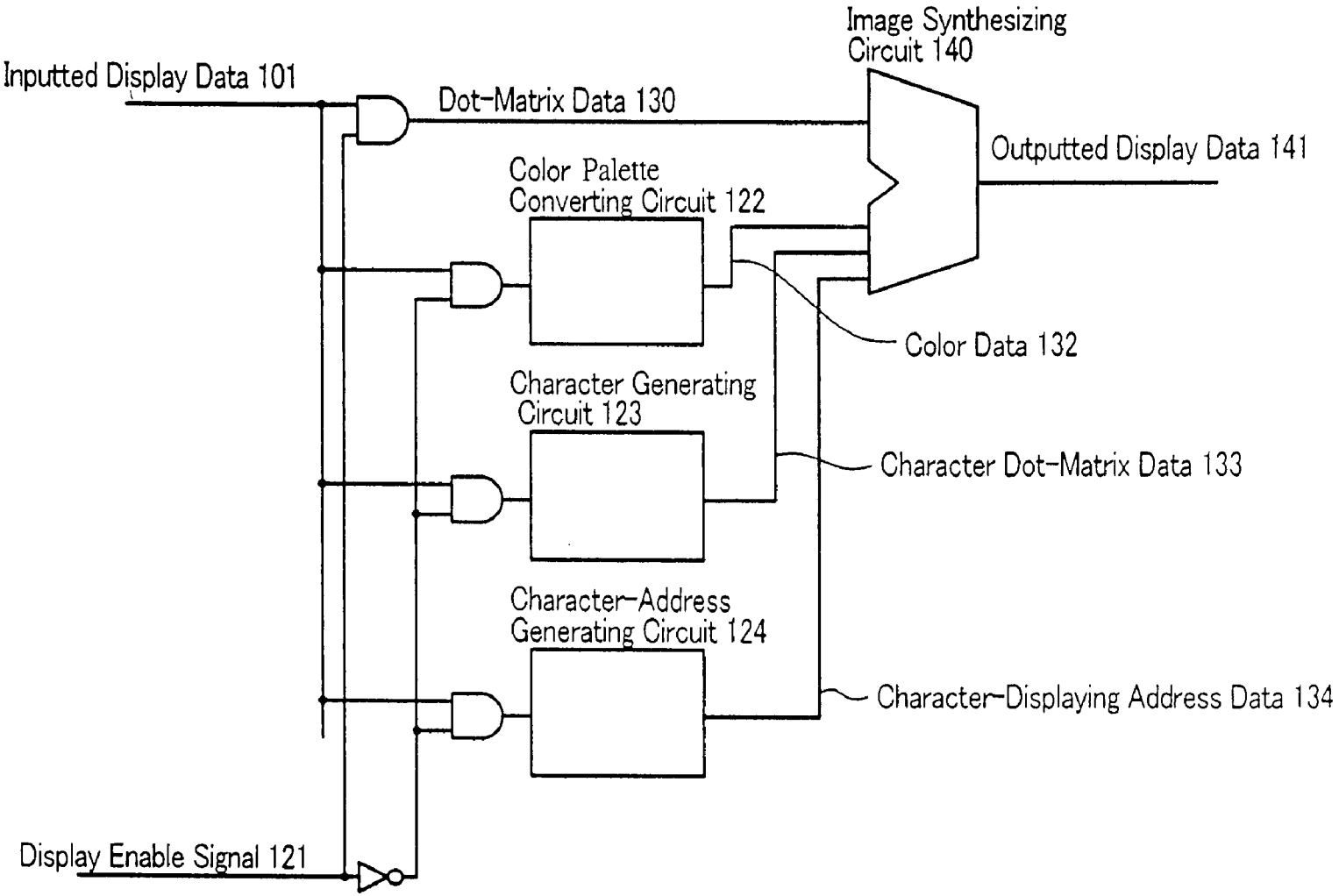
FIG. 7 is a schematic circuit diagram showing another embodiment of the liquid crystal display device according to the present invention.

FIG. 7 is a circuit diagram of another embodiment of the liquid crystal display device according to the present invention, and it shows a circuit that is incorporated inside of the above-mentioned timing converter TCON, for example.

In the circuit shown in FIG. 7, inputted display data 101 is acquired as dot-matrix data 130, during periods in which a display enable signal 121 assumes the HIGH state. Meanwhile, the inputted display data 101 is acquired as a color code, a character code and a character-address code and is inputted into a color palette converting circuit 122, a character generating circuit 123 and a character-address generating circuit 124, respectively, during periods in which the display enable signal 121 assumes the LOW state (fly-back period).

The data acquired as the dot-matrix data 130 is inputted to an image synthesizing circuit 140 and is synthesized with respective data, as will be explained later, by the image synthesizing circuit 140. The data acquired as the color codes is inputted to the color palette converting circuit 122. The color palette converting circuit 122 generates color data 132 and outputs the color data 132 therefrom. The data acquired as the character code is inputted to the character generating circuit 123, and the character generating circuit 123 generates character dot-matrix data 133 and outputs the character dot-matrix data 133 therefrom. The data acquired as the character-address code is inputted into the character-address generating circuit 124, and the character-address generating circuit 124 generates character-displaying address data 134 and outputs the character-displaying address data 134 therefrom.

The color data 132, the character dot-matrix data 133 and the character-displaying address data 134 are respectively inputted to the image synthesizing circuit 140, and these respective data are synthesized with each other, along with the above-mentioned dot-matrix data 130. The synthesized data is outputted as output display data 141 from the image synthesizing circuit 140 and is inputted to the video driving circuit He shown in FIG. 3.

In the liquid crystal display device having such a constitution, when a character display is produced along with a dot matrix display, the input data for the character display is acquired as the character data 133 and is synthesized with the dot-matrix data 130. Accordingly, the power consumption for data transfer can be reduced.

When the frequency of the character display in the pixel display is increased, the power consumption reduction effect becomes apparent, and, hence, the liquid crystal display device is also applicable for use as a liquid crystal display for a portable telephone, for example, in which a drastic reduction in the power consumption is demanded.

EMBODIMENT 3

Figure 8:
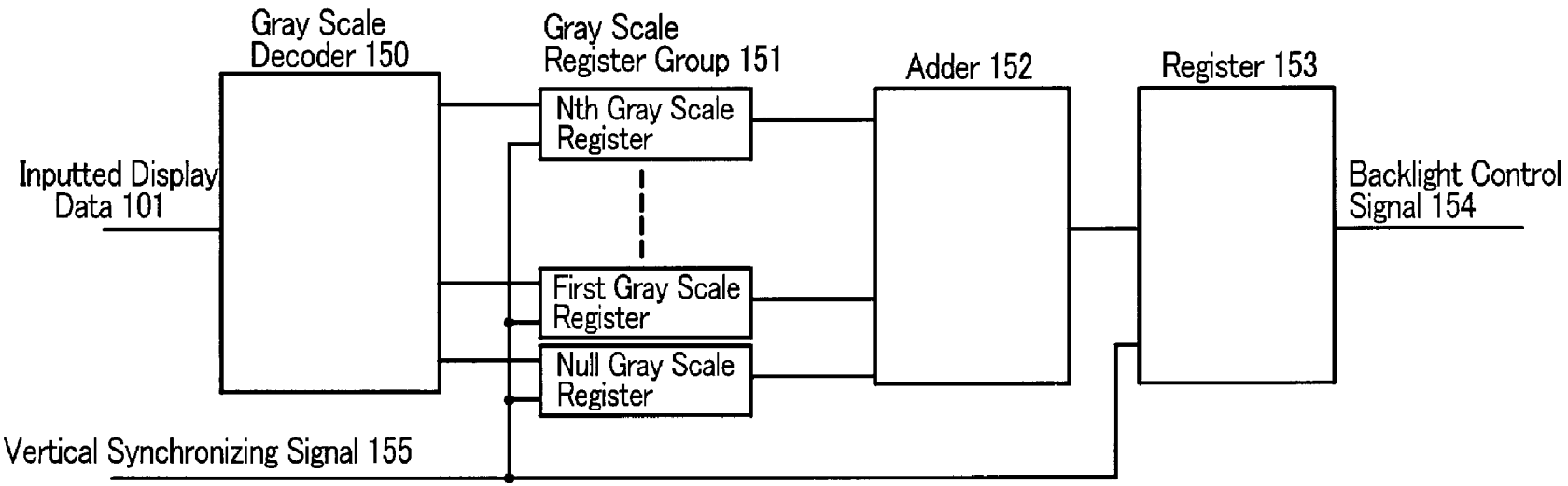
FIG. 8 is a block diagram showing another embodiment of the liquid crystal display device according to the present invention.

FIG. 8 is a circuit diagram of another embodiment of the liquid crystal display device according to the present invention, and it shows a circuit which is incorporated into the above-mentioned timing converter TCON.

In FIG. 8, first of all, there is provided a gray scale decoder 150. Inputted display data 101 is inputted into the gray scale decoder 150. The inputted display data 101 is constituted of a large number of pixel data which have respective gray scales ranging from 0 to N. The gray scale decoder 150 classifies respective pixel data in accordance with the respective gray scales thereof. When there is pixel data which corresponds to a particular gray scale among the respective gray scales, a signal "1" for example, is outputted; and, when there is no pixel data which corresponds to a particular gray scale among the respective gray scales, a signal "0", for example, is outputted.

More particularly, the gray scale decoder 150 includes (N+1) output terminals, and it outputs a signal indicative of the presence/absence of pixel data of null gray scale level, a signal indicative of the presence/absence of pixel data of a first gray scale level, a signal indicative of the presence/absence of pixel data of second gray scale level, . . . , or a signal indicative of the presence/absence of pixel data of Nth gray scale level in the inputted display data 101, from a corresponding output terminal. Here, even when the inputted display data 101 includes a plurality of pixel data of Nth gray scale level, for example, the gray scale decoder 150 outputs a signal of "1" from the corresponding output terminal irrespective of the number of pixel data.

Further, respective outputs from the gray scale decoder 150 are inputted to a gray scale register group 151, consisting of a null gray scale register, a first gray scale register, . . . , and an Nth gray scale register. That is, a signal indicative of the presence/absence of null gray scale pixel data outputted from the gray scale decoder 150 is inputted to the null gray scale register, a signal indicative of the presence/absence of the first gray scale pixel data outputted from the gray scale decoder 150 is inputted to the first gray scale register, . . . , and a signal indicative of the presence/absence of the Nth gray scale pixel data outputted from the gray scale decoder 150 is inputted to the Nth gray scale register. Accordingly, either the signal "1" or the signal "0" will be stored in respective gray scale registers which constitute the gray scale resister group 151.

Further, the respective outputs of the respective gray scale registers are inputted to an adder 152. The adder 152 adds respective outputs from the respective gray scale registers and outputs a signal corresponding to the added value. For example, when all "1" signals are inputted to the adder 152 from the null gray scale register, the first gray scale register, . . . , and the Nth gray scale register, respectively, a signal which corresponds to the added value (N+1) of respective signals is outputted. Further, when the signal "1" is inputted to the adder 152 from the fourth gray scale register and the sixth gray scale register and the signal "0" is inputted to the adder 152 from all of the other remaining gray scale registers, a signal which corresponds to the added value (2) of respective signals is outputted from the adder 152.

As can be understood from the above description, the adder 152 detects the degree of change of the gray scales in the inputted display data 101. That is, the adder 152 detects the degree of change of gray scales in the inputted display data 101 and determines whether the inputted display data 101 is data related to moving images or not based on the magnitude of the degree of change of the gray scales, that is, based on the output of the adder 152. When the degree of change of gray scales is large, the image is regarded as an image which includes motion and, accordingly, is determined to be a moving image; while, when the degree of change of gray scales is small, the image is regarded as an image which does not include motion and, accordingly, is determined to be a still image, such as an image used in word processing, table calculation, mail or the like.

Then, an output from the adder 152 is inputted to and held by a register 153, and, thereafter, it is outputted as a backlight control signal 154. The backlight control signal 154 is inputted to a backlight BL that is arranged on a back surface of the above-mentioned liquid crystal display panel PNL, and this signal controls the brightness of the backlight BL.

A vertical synchronizing signal 155 is inputted to the respective gray scale registers of the above-mentioned gray scale register group 151 and the register 153, so that the respective gray scale registers of the above-mentioned gray scale register group 151 and the register 153 are reset by this vertical synchronizing signal 155. Accordingly, the control signals from the register 153 to the backlight BL are generated for every inputted display data which corresponds to one screen.

In the liquid crystal display device having such a constitution, a moving image displayed on the liquid crystal display panel PNL is displayed with brightness greater than the brightness obtained in the display of still images. Accordingly, it is possible to clearly display the motion of the moving image. On the other hand, it has been confirmed that it is possible to clearly display a still image even when the brightness is not so large. Further, by detecting the distinction between a moving image and a still image and by producing a display with optimum brightness corresponding to such detection, it is possible to obtain the advantageous effect that the power consumption can be reduced.

Although the above-mentioned respective embodiments describe different constitutions, it is needless to say that two or all of these circuits described in the embodiments can be combined. Further, it is needless to say that by providing the changeover means to a conventional constitution, the respective circuits can be operated by way of these changeover means.

As can be clearly understood from the foregoing description, by using the liquid crystal display device of the present invention, it is possible to suppress the generation of flicker. It is also possible to reduce the power consumption. It is further possible to clearly display moving images.

What is claimed is:

1. A liquid crystal display device, which has pixels arranged in the form of a matrix, with each group of pixels forming respective lines extending along gate signal lines, and which comprises means for alternating the polarities of voltages applied to a liquid crystal during a frame period with respect to an alternation signal, comprising:

means for accumulating signal levels of pixel data for odd-numbered lines of the pixels for every frame period;

means for accumulating signal levels of pixel data for even-numbered lines of the pixels for every frame period;

subtracting means for obtaining a subtracted value by subtracting one of the accumulated values of the signal levels for the odd-numbered lines and one of the accumulated values of the signal levels for the even-numbered lines from one another; and alternation signal transmitter means for transmitting an alternation signal different from a current alternation signal when, the subtracted value obtained by the subtracting means is not less than a reference value.

2. A liquid crystal display device according to claim 1, further comprising means for altering the reference value.

3. A liquid crystal display device comprising:

a plurality of gate signal lines;

a pixel matrix comprising a plurality of pixel lines extending along the plurality of gate signal lines;

a first accumulator which accumulates levels of pixel data for odd-numbered lines of the plurality of pixel lines for every frame period;

a second accumulator which accumulates levels of pixel data for even-numbered lines of the pixel lines for every frame period;

a subtracter which obtains a subtracted value by subtracting the accumulated values of the levels for the odd-numbered lines of a frame and the accumulated values of the levels for even-numbered lines of the frame from one another; and an alternation signal transmitter which transmits an alternation signal different from a current alternation signal when the subtracted value obtained by the subtracter is not less than a reference value.

4. A liquid crystal display device according to claim 3, further comprising a reference voltage changing circuit for altering the reference value.

5. A liquid crystal display device comprising:

a plurality of gate signal lines and a plurality of drain signal lines;

a plurality of pixels surrounded by the plurality of gate signal lines and the plurality of drain signal line, and each of the plurality of pixels having a switching element and a pixel electrode;

an input terminal receiving display data from an external system;

a first accumulator which obtains a first value by accumulating a red data of a first pixel of the plurality of pixels, a blue data of the first pixel, and a green data of a second pixel of the plurality of pixels;

a second accumulator which obtains a second value by accumulating a red data of the second pixel, a blue data of the second pixel, and a green data of the first pixel;

a subtracter which obtains a subtract value by subtracting between the first value and the second value; and an alternation signal transmitter which outputs an alternation signal different from a current alternation signal when the subtract value is equal to or more than a reference value.

6. A liquid crystal display device according to claim 5, wherein the first value and the second value accumulated by the first accumulator and the second accumulator are accumulated all display data of one frame.

* * * * *